United States Patent [19]

Grupping

[11] 4,441,554

[45] Apr. 10, 1984

[54] METHOD FOR THE UNDERGROUND GASIFICATION OF COAL OR BROWNCOAL

[76] Inventor: Arnold W. J. Grupping, Anjelierenlaan 3, Aerdenhout, Netherlands, 2111 BP

[21] Appl. No.: 322,476

[22] Filed: Nov. 18, 1981

[30] Foreign Application Priority Data

Nov. 28, 1980 [NL] Netherlands ..... 8006485

[51] Int. Cl.[3] ..... C10J 5/00; E21B 43/243

[52] U.S. Cl. ..... 166/261; 48/DIG. 6; 166/262

[58] Field of Search ..... 166/256, 259, 261, 292, 166/285, 262; 48/DIG. 6

[56] References Cited

U.S. PATENT DOCUMENTS

| | | | |
|---|---|---|---|
| 3,331,438 | 7/1967 | Slusser | 166/261 |
| 3,566,967 | 3/1971 | Shelton | 166/261 |
| 3,999,607 | 12/1976 | Pennington et al. | 166/259 |
| 4,024,914 | 5/1977 | Kreinin | 166/256 X |
| 4,083,402 | 4/1978 | Antonova et al. | 166/256 X |
| 4,095,650 | 6/1978 | Shuck | 166/256 |

FOREIGN PATENT DOCUMENTS

| | | | |
|---|---|---|---|
| 2313921 | 10/1974 | Fed. Rep. of Germany . | |
| 2846832 | 10/1978 | Fed. Rep. of Germany . | |
| 1053378 | 2/1954 | France | 166/256 |

OTHER PUBLICATIONS

Wilkins, "The Underground Gasification of Coal", *The Gas World,* Nov. 25, 1944, pp. 545–550.

Thring, "Underground Gasification of Coal", *Mining Congress Journal,* Sep. 1944, pp. 37, 38 and 52.

Chabarek, S. and Martell, A., *Organic Sequestering Agents,* John Wiley & Sons, Inc., 1959, pp. 455–467.

Wallace, A., *Farm Chemicals* 133, 3, (1977), pp. 34, 36, 38, 40 and 42.

*Primary Examiner*—Stephen J. Novosad

*Attorney, Agent, or Firm*—Beehler, Pavitt, Siegemund, Jagger & Martella

[57] ABSTRACT

A method for the underground gasification of coal or browncoal in an inclined coal layer, in which two boreholes are drilled into said layer, and are continued downwards in a converging manner with the inclination of said layer. After initiating the combustion of the coal, the cavity formed thereby is filled by a granular filler material suspended in a carrier substance supplied through a borehole, the cavity then being filled with the exception of a narrow channel in which the combustion of a substantially straight coal front can be continued. When using a carrier liquid, the latter is pressed out by means of a pressurized gas before restarting the combustion. If water is flowing in from the surrounding formations, it can be kept away from the filler near said channel by barometric action by means of a tube extending downwards in a borehole to the desired water level, the pressure being maintained during combustion, e.g. by including suitable throttle means in the gas discharge.

11 Claims, 5 Drawing Figures

METHOD FOR THE UNDERGROUND GASIFICATION OF COAL OR BROWNCOAL

The invention relates to a method for the underground gasification of coal or browncoal in an inclined coal layer, in which two boreholes are drilled from the soil surface into the coal layer, which boreholes are continued downwards in said layer with the slope of said layer, and are interconnected at their lower ends, after which the coal can be ignited, and, furthermore, by supplying an oxygen containing gas through one of the boreholes and discharging the combustion gases through the other borehole, the combustion front will be propagated upwards through the coal layer, and care is taken that the boreholes remain in communication with the cavity behind the combustion front, which cavity is, moreover, intermittently filled with a filler which is supplied through one of the boreholes.

Such a method has been described in the prior NL patent application No. 77 10 184 of the same applicant. In particular the boreholes, at least near their lower extremities, converge towards one another, so as to facilitate the formation of the connection between both boreholes required for initiating the gasification, and by the upward divergence of these boreholes the gasification front will obtain a length which is sufficient for an economic production.

The filler serves to support the upper layer and to prevent its collapse, and, on the other hand, to ensure that the oxygen containing gas flow will contact the burning coal as sufficiently as possible. In the case of a too wide passage, a part of this gas flow will flow off directly towards the other borehole, as will, then, be lost for the combustion, and, moreover, the presence of oxygen containing gas in the produced combustion gases can be dangerous. Therefore a not too wide passage above the filler should be maintained in which the gas flow is turbulent, so that an optimal use of the oxygen is made possible.

It is possible to use, for filling, a thick slurry of a hardening material such as cement, but, apart from the cost, this has the draw-back that in the cavity solid particles will separate too quickly from the slurry, and/or the hardenable material solidifies too early at the prevailing temperatures. This will lead in both instances to obstruction of the cavity and an insufficient filling thereof, in particular as soon as said cavity has obtained a certain extension. A consequence of this insufficient and non-uniform filling will be that collapses can no longer be avoided, and that, furthermore, the gas flow will insufficiently come into contact with the coal, so that the composition of the gas will become poor and unstable accordingly, and, because of the presence of oxygen in the gas mixture, an explosion hazard near or in the discharge hole will arise. Moreover a consequence of a non-uniform filling will be that the combustion front obtains an irregular shape, so that filling the cavity further will become still more difficult.

Although it has been contemplated to fill the cavity with a granular material, e.g. sand, which is led into the cavity in a gas or liquid flow through the borehole, this has been considered to be impracticable until now, since it was thought that it would not be possible to fill the cavity in this manner in a sufficient degree, i.e. because of an irregular deposition, dragging away of already deposited particles, the possibility of obstruction near the supply hole etc., and, furthermore, it was assumed that such a manner of filling would be completely uncontrollable, so that the uniform filling required for a straight combustion front would never be obtained.

The invention is based on the insight obtained from experiments on models, during which it has appeared that the deposition from a suspension of the grains used for filling begins when entering the cavity, where the flow velocity of the suspension is sharply reduced, and, as soon as the passage is locally narrowed, a break-through will take place leading to a deposition beyond the original deposition, which break-through will move upwards to near the coal front, all this in such a manner that, eventually, the whole cavity is filled, with the exception of a relatively narrow passage having such dimensions that an equilibrium between the deposition from the suspension and the dragging along with the suspension is obtained. It has, then, also appeared that this deposition can be controlled by a suitable choice of, inter alia, the concentration of the suspension and its flow velocity.

The method of the invention is, therefore, characterised in that the filler material is suspended in a carrier substance, which suspension is led through the boreholes and the cavity, and this in such a concentration and with such a flow velocity that the filler material, at the reduction of the flow velocity when entering the cavity, will precipitate from the suspension, and the suspension flow is continued until the cavity has been completely filled with the filler material, with the exception of a narrow channel at the upper side of this cavity near the coal front, having a width which is determined by the flow velocity in that region at which an equilibrium between precipitation and dragging along of the filler material is reached.

If the filler material is suspended in a liquid, in particular water, the liquid is to be removed from the channel after filling and before the gasification can be restarted again, which can be done by passing through a gas, in particular air.

The intergranular spaces of a filling thus obtained are filled by the suspension liquid. The presence of this liquid near the hot gasification front can, however, be disadvantageous, since the water will evaporate at the surface so that the gas composition may be changed, and, moreover, much heat will be withdrawn from the gasification front. Furthermore a filler which is considerably mixed with a liquid will behave as a liquid which, then, cannot sufficiently withstand the ground pressure, and will, therefore, be pressed away sometimes by the ground pressure, so that the gasification channel may be closed thereby. Sometimes, therefore, the filler should at least partly be stripped of the suspension liquid. According to the invention this can be done by lowering an inner tube in one of the boreholes, the lower ends of this tube and of the borehole in question extending to different depths, and, thereafter, a pressurised gas is supplied to the cavity through the inner tube or through the annular passage surrounding this tube, the other borehole being closed, or through the other borehole, said inner tube or said surrounding passage then being closed, and as a consequence thereof a liquid column will be pressed upwards in the not-closed passage, the height of said column corresponding to the gas pressure, reduced, as the case may be, with the pressure prevailing above said liquid column. In this manner the liquid in the filler can be pressed away to a desired level which cannot be situated deeper than the opening of the passage in which the liquid column has been pressed away. By varying the pressure, the length of the inner tube and/or the pressure above the liquid pressed upwards, the liquid level can be accurately adjusted. If water continues to flow in from the surroundings, a suitable choice of the pressure will ensure that the liquid column will extend up to the soil surface, and there the water can flow off then continuously, and by using a suitable throttle a counter-pressure can be maintained if necessary. The passage of the borehole provided with an inner tube not used for pressing upwards the water column can, furthermore, be used for supplying the gas required for the combustion, or for discharging the produced combustion gases, and it should be ensured of course that these gases remain under the above-mentioned pressure, and suitable throttle means in the passages used for gas discharge can be used to this end.

Instead of using a liquid suspension, the granular material can also be mixed with a gas which is put under such a high pressure that the viscosity and density thereof sufficiently increase for obtaining the flow conditions required for the desired deposition of filler material. In that case no suspension liquid is to be expelled from the filler. By maintaining the pressure, water which possibly flows in from the surroundings can, of course, be kept away from the gasification front again.

In some instances the eventually obtained channel will be too narrow for the flow conditions desired for filling. From experiments it has appeared that such a channel can be enlarged in a controlled manner by leading through a liquid, e.g. the pure carrier liquid, mixed or not with a gas. From experiments relationships between the gas velocity, the slope of the coal layer, the grain size and the density of the filler material, the character of the liquid, and the obtained passage cross-section have been deduced, enabling a sufficiently accurate control of the dimensions of the channel.

Sometimes it can be advantageous to introduce into the upper layer of the filler stripped of the liquid a substance for strengthening or hardening said filler.

Finally it can be favorable to reverse the flow sense of the oxygen containing gas as soon as the combustion region is approaching the discharge borehole, so that, then, the last part of the coal layer will act as the oxidation region, and the original oxidation region as the reduction region, so as to maintain a constant gas composition until the end, and to avoid a too high temperature near the borehole which, initially, acted as the gas discharge.

The invention will be elucidated below in more detail by reference to a drawing, showing in:

Figure 1:
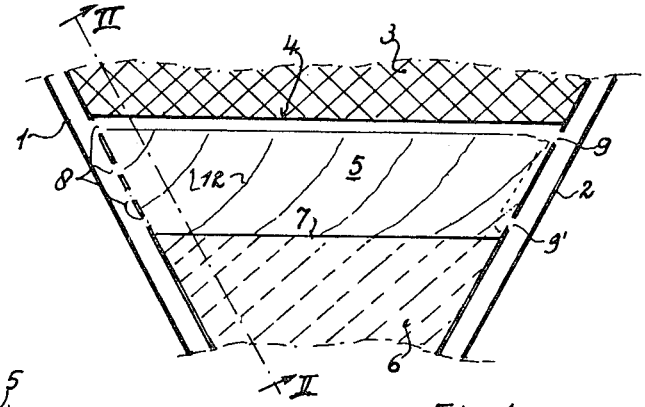
FIGS. 1 and 2 show two cross-sections of a coal layer and the adjacent cavity according to line I—I of FIG. 2 or II—II of FIG. 1 resp.
Figure 2:
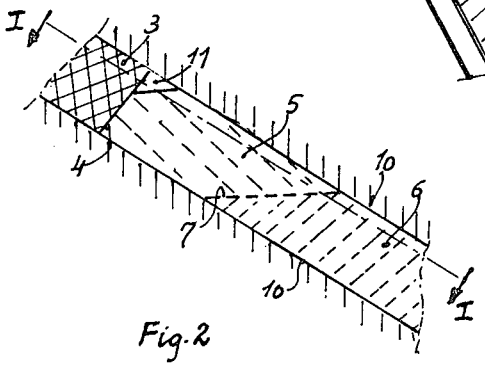

In FIG. 1 two boreholes 1 and 2 are shown which, as described in the prior NL patent application No. 77 10 184, extend in the direction of a coal layer 3, and can approach one another in the downward direction. It is assumed here that the coal layer 3 has been burned away to form a straight coal front 4, the underlying cavity 5 having been filled before by means of a filler 6 up to 7. As described in said prior patent application, a straight profile of the coal front 4 can be obtained by filling the initially formed cavity, which can have an irregular shape, with a heavy slurry or a solidifying or hardening mass such as cement, so that a straight filling surface is obtained which will remain straight also at later fillings. Since, initially, the bores 1 and 2 are situated very closely to one another and the cavity is accordingly small, filling it with such a mass will proceed without difficulties.

The filling 6 according to the invention consists, for instance, of sand or similar granular material. As soon as the cavity 5 has become so large by burning away the coal layer 3 that the air or other oxygen containing gas supplied, for instance, through the borehole 1 begins to flow in a substantially laminar manner, and will, then, no longer completely contact the combustion region, the cavity 5 is to be filled again. The combustion is, then, to be interrupted. For filling the cavity 5 use is made of the boreholes 1 and 2, communicating with the cavity 5 by means of ports 8 and 9 resp. Ports situated at a lower level, possibly used during the preceeding gasification steps, can be temporarily closed by means of suitable inner tubes, as far as said ports still communicate with the cavity. During the progression of the coal front 4 additional ports 8 and 9 have to be made of course. The manner in which this is done is known, so that no further description thereof is required.

If, for instance, a sand-water suspension is supplied through the borehole 1, the flow velocity thereof will sharply decrease after leaving the port 8, so that deposition of sand will start immediately behind said port. The water fills the space 5 and can flow off through the other port 9. Because of the deposition of sand the passage is gradually narrowed, which will lead to an increasing flow velocity and, eventually, to a break-through which, because of the upward slope of the boundary walls 10 of space 5, starts to revolve upwards, which will, eventually, lead to a passage 11 situated against the coal front 4. The boundary of the deposition in successive steps is schematically indicated at 12 in FIG. 1, and break-through will occur again and again which moves upwards so that, eventually, a continuous channel 11 extending between the ports 8 and 9 is obtained. A small space 5' will remain free, unless the discharge can take place through a lower port 9', and then the channel 11 will extend downwards along the boundary of the borehole 2 until the port 9' has been reached. The port 9' can, for instance, be the discharge port for the combustion gases used during the preceeding combustion step, and, again, as indicated above, a suitable tubing can be used for temporarily closing specific ports.

This manner of sand deposition has been ascertained by means of model experiments, in which scale factors have been taken into account. Thereby relationships between the concentration of the suspension, the grain size of the filler material, the density of the grains and the carrier, and the flow velocity of the suspension, have been determined, which, taking into account the scale factors, can be used for controlling the filling of an underground cavity 5.

When supplying an oxygen containing gas and discharging the produced combustion gases, the channel 11 thus obtained can, sometimes, be too narrow, i.e. will have a too large flow resistance, for obtaining an efficient gasification. The sedimentation of the granular filler material cannot always be controlled in such a manner that a wider channel is obtained. In that case, now, the channel 11 present at the end of the filling operation can be flushed with a suitable liquid, i.e. generally water. From model experiments relationships have been derived indicating the relation between the grain size and the density of the filling, the flow velocity, the density and the character of the liquid flow, the slope of the coal layer and the obtained channel cross-section, so that the desired channel cross-section can be adjusted without difficulty by a corresponding choice of the liquid flow velocity. Also the viscosity of the liquid is important in this respect. Therefore it can sometimes be favorable to use, instead of a flushing liquid, a mixture of a gas and a liquid, in particular air and water.

After forming the channel 11 and, as the case may be, widening the latter by means of a flushing liquid, the present liquid is to be expelled from the channel and the boreholes, which can be done with the aid of a pressurised gas.

The filling 6, extending up to the channel 11, consists of sand grains or the like, and the interstices between the grains are filled with a liquid, i.e. generally water. A disadvantage is that such a filling can behave as quicksand, and may be pressed away by the ground pressure acting on the surfaces 10, instead of taking up said pressure. Another disadvantage is that, when water is flowing inward from the surrounding ground layers, the channel will get filled so that the gasification becomes impossible. Even if this does not take place, the presence of water in the filling can be harmful, since the water will absorb relatively much heat, and will change the composition of the gas when evaporating. It is, therefore, often advisable to remove the water at least partially from the filling.

Figure 3:
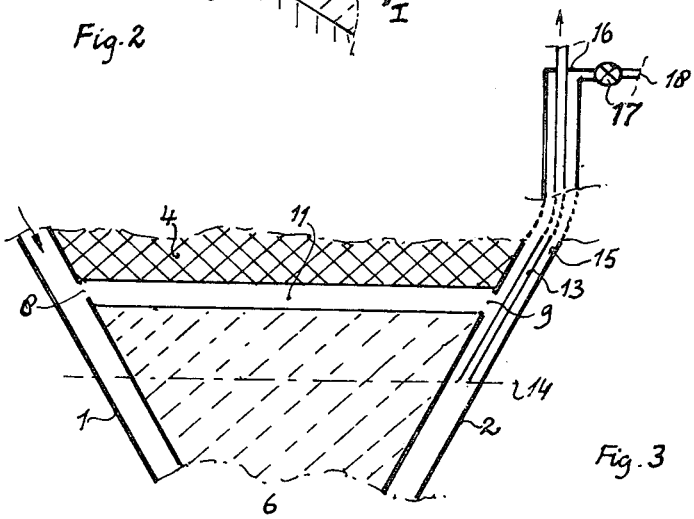
FIG. 3 is a corresponding cross-section with a completely filled cavity, and with means for removing water therefrom.

This can, for instance, be done in the manner shown in FIG. 3. Thereto an inner tube 13 is arranged in one of the boreholes, in this case the discharge borehole 2, said tube extending to the eventually desired water level 14. The interspace 15 between the tube 13 and the wall of the borehole 2 is closed at 16 above the soil surface, and communicates, by means of a regulating valve 17, with a discharge tube 18. If, now, gas pressure is applied to the borehole 1 while the valve 17 is closed, the tube 13 will be filled with water until the length of the water column corresponds to the gas pressure. If the gas pressure is higher than corresponds to the length of the tube 13, water will flow from the tube 13 at the upper end until the water in the filling has reached the level 14. Furthermore it is possible to apply a counter-pressure to the tube 13, or to provide the latter with a regulating valve or throttle so that, then, a higher pressure than corresponds to the water column will be obtained. This can be useful for preventing that, upon reaching the level 14, substantial amounts of gas will escape through the water column. When performing the gasification under this pressure, which can be controlled by adjusting the valve 17 through which the produced gas escapes, the filling will remain dry as low as the adjusted level. When water is flowing in from the surroundings, it can flow off through the tube 13, and the liquid level remains maintained at the desired level by adjusting the pressure and, as the case may be, the counter-pressure.

Of course the tasks of the tube 13 and the interspace 15 can be interchanged, and it is also possible to close the borehole 1, and to apply the gas pressure through that part of the borehole 2 which is not used for the water column. The borehole 1 can then be used for discharging the produced combustion gas, and this hole can be provided with an adjustable valve to that end.

As soon as the upper layer of the filling 6 is stripped of water, this upper layer can be filled in one or more additional operations with a solidifying substance or with a substance mutually adhering the grains of the filler material, thus obtaining a surface which is insensitive for gas flows, so that no grains will be dragged away therefrom by the gas flow anymore, and this surface will remain straight under all circumstances. Furthermore no erosion will occur in the discharge borehole, and, moreover, evaporation of water from the underlying layers through the surface will be counteracted. As soon as the surface has been sufficiently sealed in this manner, the water level in the underlying layers can be raised if necessary.

Instead of using a liquid suspension for filling the cavity 5 with the filler 6, sometimes use can be made of a gas which is put under such a high pressure that its viscosity and density become sufficiently high for obtaining the desired flow and deposition behaviour. The advantage thereof is that, afterwards, no liquid is to be expelled from the formed channel 11, and the pressure can be chosen so that water possibly flowing in from the surroundings will be kept away from the channel 11. In this manner the gasification can be initiated more quickly, in particular when an oxygen containing gas is used for introducing the filler material.

Figure 4:
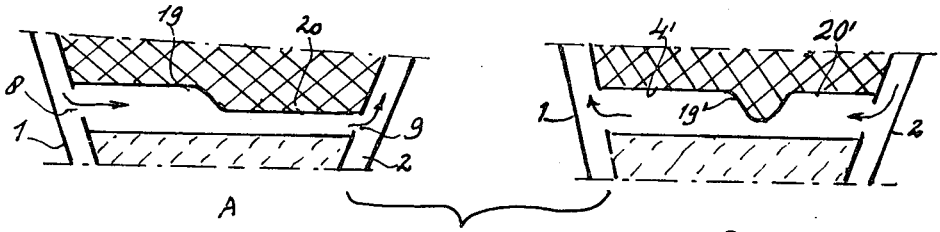
FIGS. 4A and B show two simplified cross-sections corresponding to a portion of FIG. 1 for elucidating the progression of the combustion front.

In FIG. 4A it is indicated how the gasification takes place. The oxygen containing gas supplied through the borehole 1, e.g. air mixed or not with water or steam, maintains the combustion in the coal layer 3, and oxidation of the coal will take place in a region 19 where the carbon is burned to carbon dioxide, and in the presence of water vapor also hydrogen and/or methane can be produced. The carbon dioxide produced will be reduced again thereafter to carbon monoxide by contact with the coal in the region 20, and the produced gases flow off through the borehole 2. As, however, the oxidation region 29 moves onward towards the discharge hole 2, the reduction region 20 will become shorter accordingly. If, however, this region becomes too short, the reduction will become insufficient, so that the discharged gas will contain more and more carbon dioxide, and also the temperature of the gas will become higher which can be harmful for the tubings present in the borehole 2.

In order to remove this disadvantage, the gas flow is reversed in the manner of FIG. 4B as soon as the reduction region 20 would become too short, which can be ascertained by determining the carbon dioxide percentage. This means that, now, the original reduction region 20 becomes the oxidation region, as indicated at 20', and the new coal front 4' formed behind the original oxidation region 19 will act as the reduction region. In this manner the whole coal front can be burned away without changes in the composition of the gas and without the temperature thereof becoming too high. If, in the manner of FIG. 3, the gasification takes place under a high pressure, both boreholes 1 and 2 should, of course, be provided with suitable valves enabling to maintain the desired pressure also when reversing the sense of flow. Reversing the flow sense makes only sense if, in the manner of the invention, a substantially uniform channel 11 is formed above the filling 6, in which, along the total length, comparable flow conditions are present.

In the manner described above it becomes possible now to obtain an efficient gasification of underground coal layers with a good yield, and the composition of the gas can always be maintained at an optimal value. The relationships derived from model experiments allow to obtain, under all circumstances, an adapted cross-section of the channel 11.

I claim:

1. A method for underground gasification of coal or browncoal in an inclined coal layer, in which two boreholes are drilled from the soil surface into the coal layer, which boreholes are continued downwards in the coal layer with the slope of this layer, and which boreholes are interconnected at their lower ends, after which the coal is ignited, supplying an oxygen containing gas through one of the boreholes and discharging the combustion gases through the other one, the combustion and gasification front thus moving upwards, and taking care that the boreholes remain in communication with the cavity behind the combustion front, and, intermittently filling the cavity with a filler supplied through one of the boreholes, said method comprising suspending the filler material in a carrier substance, leading the suspension through the boreholes and the cavity with such a concentration and flow velocity that the filler material, at the reduction of the flow velocity when entering the cavity, will precipitate from the suspension; and, continuing the suspension flow until the cavity has been completely filled with the filler material with the exception of a narrow channel at the upper side of this cavity near the coal front, the width of said channel being determined by the flow velocity therein at which an equilibrium between precipitation and dragging along of the filler material is reached.

2. The method of claim l, in which the filler material is suspended in a liquid, further comprising, before restarting the gasification, removing the liquid from the channel by means of a gas, such as air.

3. The method of claim 2, further comprising the step of partly stripping the filler of the suspension liquid by lowering an inner tube in at least one of the boreholes, the lower ends of this tube and of the borehole in question extending to different depths, and thereafter supplying a pressurised gas to said cavity through said inner tube or through the annular passage surrounding said tube, the other borehole being closed, or through the other borehole, said inner tube or the surrounding passage being closed, and as a consequence thereof a liquid column will be pressed upwards in the not-closed passage, the height of said column corresponding to the pressure of the gas, reduced, as the case may be, by the pressure prevailing above said liquid column.

4. The method of claim 3, further comprising the step of supplying the pressure such that the liquid column extends up to the soil surface so as to discharge water flowing in from the surroundings into the cavity.

5. The method of claim 4, further comprising providing the passage in which the liquid column rises with a throttle passage for maintaining a counter-pressure.

6. The method of any one of claims 3–5, further comprising providing the passages for discharging the produced combustion gases and/or supplying oxygen containing gas with suitable throttling elements for maintaining the desired pressure in the cavity.

7. The method of any one of claims 1–5, further comprising mixing the filler material with a gas which is put under such a high pressure that its viscosity and density are sufficient for obtaining the flow conditions required for deposition of the filler material.

8. The method of any one of claims 1–5, further comprising enlarging the formed channel after filling by leading a liquid, in particular the pure carrier substance, therethrough, together or not with a gas, the flow velocity being adapted to the desired channel cross-section depending on the slope of the coal layer, the grain size of the filler material, the density of the filler material and of the carrier.

9. The method of any one of claims 1–5, further comprising adding a substance for strengthening or hardening this filler to the upper layer of the filler which is stripped of the liquid.

10. The method of any one of claims 1–5, further comprising, reversing the sense of flow of the oxygen containing gas as soon as the combustion region is approaching the discharge borehole, so that, then, the last part of the coal layer will act as the oxidation region, and the original oxidation region as the reduction region.

11. The method of claim 10, further comprising providing both boreholes with suitable closing and/or throttling means for maintaining the required pressure in both flow senses.

* * * * *